US008479749B2

(12) United States Patent
Randolph

(10) Patent No.: US 8,479,749 B2
(45) Date of Patent: Jul. 9, 2013

(54) HAIR DEBRAIDER

(76) Inventor: Andrea Randolph, Croydon, PA (US)

( * ) Notice: Subject to any disclaimer, the term of this patent is extended or adjusted under 35 U.S.C. 154(b) by 0 days.

(21) Appl. No.: 12/924,499

(22) Filed: Sep. 29, 2010

(65) Prior Publication Data

US 2012/0073593 A1 Mar. 29, 2012

(51) Int. Cl.
*A45D 24/16* (2006.01)

(52) U.S. Cl.
USPC ..... 132/120; 132/149; 2/21

(58) Field of Classification Search
USPC ..... 132/120, 149, 108, 212, 219, 218, 132/270, 273, 317, 320, 321, 329, 126, 124, 132/139, 141, 142, 144; 2/21, 159; 15/105, 15/159.1, 188, 227, 160, 167.1; 119/600, 119/601, 611–617; D28/10; D4/103
See application file for complete search history.

(56) References Cited

U.S. PATENT DOCUMENTS

| | | | | | |
|---|---|---|---|---|---|
| 1,795,500 | A * | 3/1931 | Omundson | 132/149 |
| 2,154,336 | A * | 4/1939 | King | 132/139 |
| 2,154,337 | A * | 4/1939 | King | 132/212 |
| 2,272,151 | A * | 2/1942 | Hertzberg | 132/120 |
| 2,297,714 | A * | 10/1942 | Nesbitt | 132/149 |
| D137,637 | S * | 4/1944 | Nelson et al. | D4/117 |
| 2,467,975 | A * | 4/1949 | Hollen | 132/149 |
| 2,526,128 | A * | 10/1950 | Grant | 132/149 |
| 2,568,898 | A * | 9/1951 | Phillips et al. | 132/150 |
| 2,608,975 | A * | 9/1952 | Shannon | 132/149 |
| 2,686,325 | A * | 8/1954 | Silver | 15/188 |
| 2,799,283 | A * | 7/1957 | Kapusnyk | 132/120 |
| 2,821,203 | A * | 1/1958 | Kesterson et al. | 132/149 |
| 3,928,871 | A * | 12/1975 | Wall | 2/161.8 |
| 3,960,155 | A * | 6/1976 | Wall | 132/212 |
| 4,292,705 | A * | 10/1981 | Stouffer | 15/110 |
| 4,766,914 | A * | 8/1988 | Briggs | 132/212 |
| 5,803,322 | A * | 9/1998 | Boone et al. | 223/101 |
| 6,021,783 | A * | 2/2000 | Phillips | 132/200 |
| 6,095,154 | A * | 8/2000 | Robinson | 132/219 |
| 6,808,068 | B2 * | 10/2004 | Abada | 206/362.2 |
| 7,044,138 | B2 * | 5/2006 | Brown | 132/139 |
| D648,072 | S * | 11/2011 | Freeman | D28/31 |
| 2003/0203119 | A1 * | 10/2003 | Witter | 427/429 |
| 2006/0096610 | A1 * | 5/2006 | Bradford et al. | 132/212 |
| 2007/0226874 | A1 * | 10/2007 | Cain | 2/159 |
| 2011/0265808 | A1 * | 11/2011 | Conn | 132/200 |

* cited by examiner

*Primary Examiner* — Robyn Doan
*Assistant Examiner* — Tatiana Nobrega
(74) *Attorney, Agent, or Firm* — Dale J. Ream

(57) ABSTRACT

This invention is a cylindrical device placed on your finger or thumb and contains a 3 piece apparatus that can be detached coming out of the cylinder wither vertically at the apex, or on the sides. There is a pick sticking directly upwards from the finger and a mini comb and a brush between 90 to 180 degrees on each end of the pick (alternative manufacturing methods). The pick is pushed into the center of the braid and will break the braid apart. The comb or brush is used to straighten the hair as the pick breaks the braid apart.
The entire process, while usually performed with two hands, can be accomplished with one hand thus making the device easier, less tiring and less expensive than alternative devices currently on the market.

6 Claims, 5 Drawing Sheets

HAIR DEBRAIDER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

This invention relates to the field and common practice of removing braids from the hair. This total tool is a new concept in the field of braid removal in that it is designed to be used with a single finger, thus providing greater ease of use in both home and commercial applications.

2. Description of the Related Art

Hair braiding is very common in our culture these days. There are many different types of hairstyles that incorporate braids into their hair. Many hairstyles include numerous amounts of braids in their hair and all these braids need to be removed. Because braiding hair is such a common practice in these times, a tool that can efficiently remove braids should be researched and developed. Although there are many motorized and non-motorized tools to remove braids, the efficiency, speed, and convenience are lacking. Often times with the tools that are available today, people's arms get tired and it takes too long to remove braids from a person's hair. Also, many people have to use additional tools, along with other tools, to remove braids from their hair.

Due to this shortcoming in currently available debraiding tools, we must come up with tools that are easier for the consumer and can free up some time without hurting a person's arms or making them buy many different accessories.

BRIEF SUMMARY OF THE INVENTION

This invention fits on your finger and has a mini comb, a brush, and a pick coming out of the thimble on the finger. The pieces can be disconnected based on the consumers preference. These can be used together or in combination.

There is a brush coming out on side of the apparatus, a "mini comb" 180 degrees across from the brush, and a pick perpendicular to these. The pick will have a sharp point. The whole invention is so small and compact it can fit in a persons pocket.

DETAILED DESCRIPTION OF THE INVENTION

Figure 1:
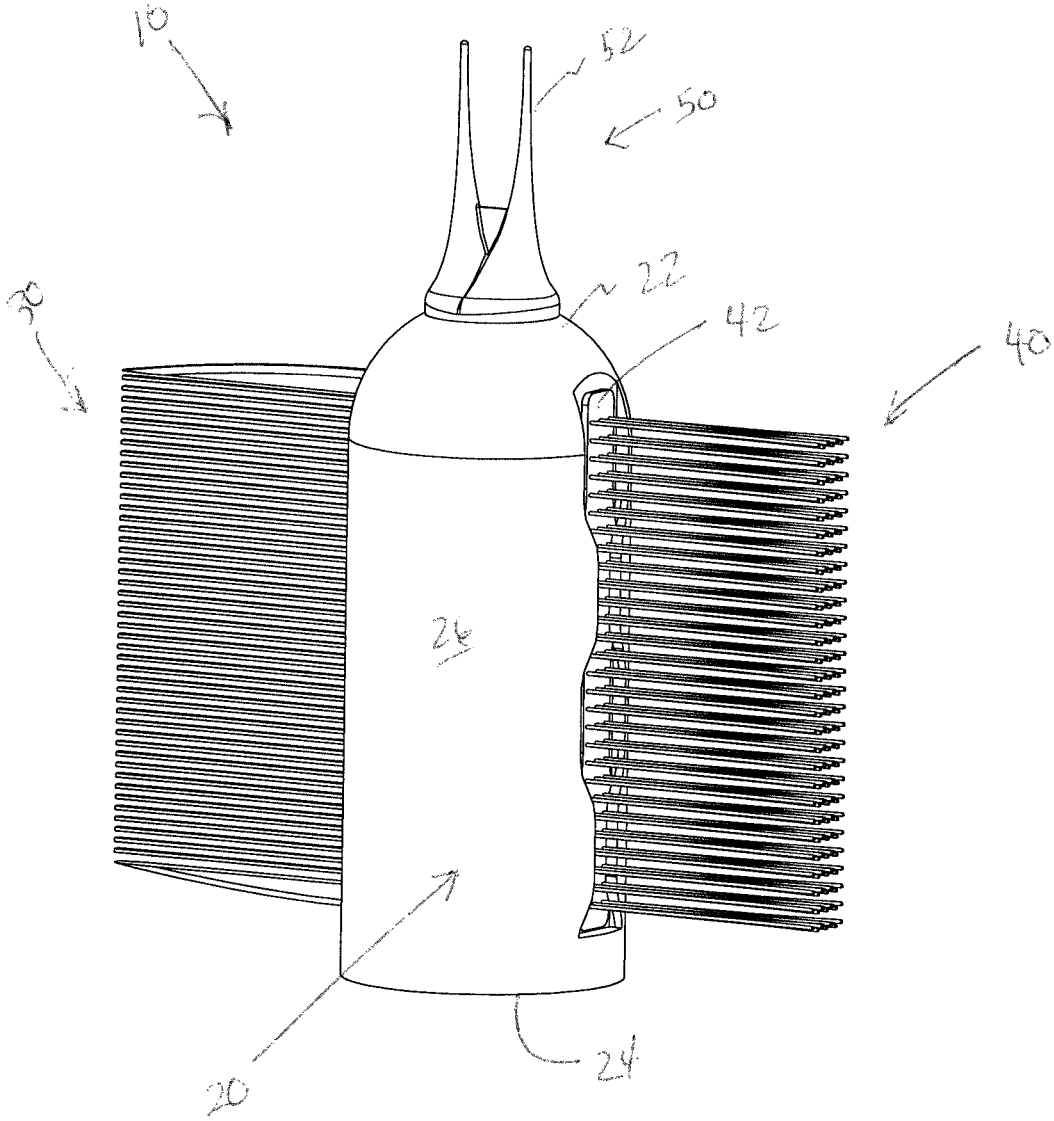
FIG. 1: Assembled view of braid removal tool comprising a finger cover, comb member, brush member, and pick member

The present invention relates to a hair debraiding tool 10 that includes a stretchable finger cover with places for insertion of various attachments including a min-comb, mini-brush and pick. The hair debraiding tool will be described with reference to the accompanying drawings.

The finger cover 20 includes an apex 22 and defines an open bottom 24. The finger cover 20 includes a plurality of side walls 26 that define an interior area. The bottom is in communication with the interior area and configured to receive a finger or thumb of a user into the interior area. A first respective side wall includes a first tongue and groove structure 28. Another respective side wall includes a second tongue and groove structure 29. Preferably, the first and second respective side walls are opposite one another or, in other words, situated about 180 degrees relative to the other. The finger cover 20 is constructed of an expandable material such as rubber, plastic, or leather such that one size fits all users.

The debraiding tool 10 may include a comb member 30 that includes a comb member connector 32. The comb member 30 includes a plurality of bristles extending outwardly from the comb member connector 32. The comb member connector 32 includes a configuration that may be selectively and slidably coupled to the first tongue and groove structure 28. Similarly, the debraiding tool 10 may include a brush member 40 that includes a brush member connector 42. The brush member 40 includes a plurality of bristles extending outwardly from the brush member connector 42. The brush member connector 42 includes a configuration that may be selectively and slidably coupled to the second tongue and groove structure 29.

Figure 2:
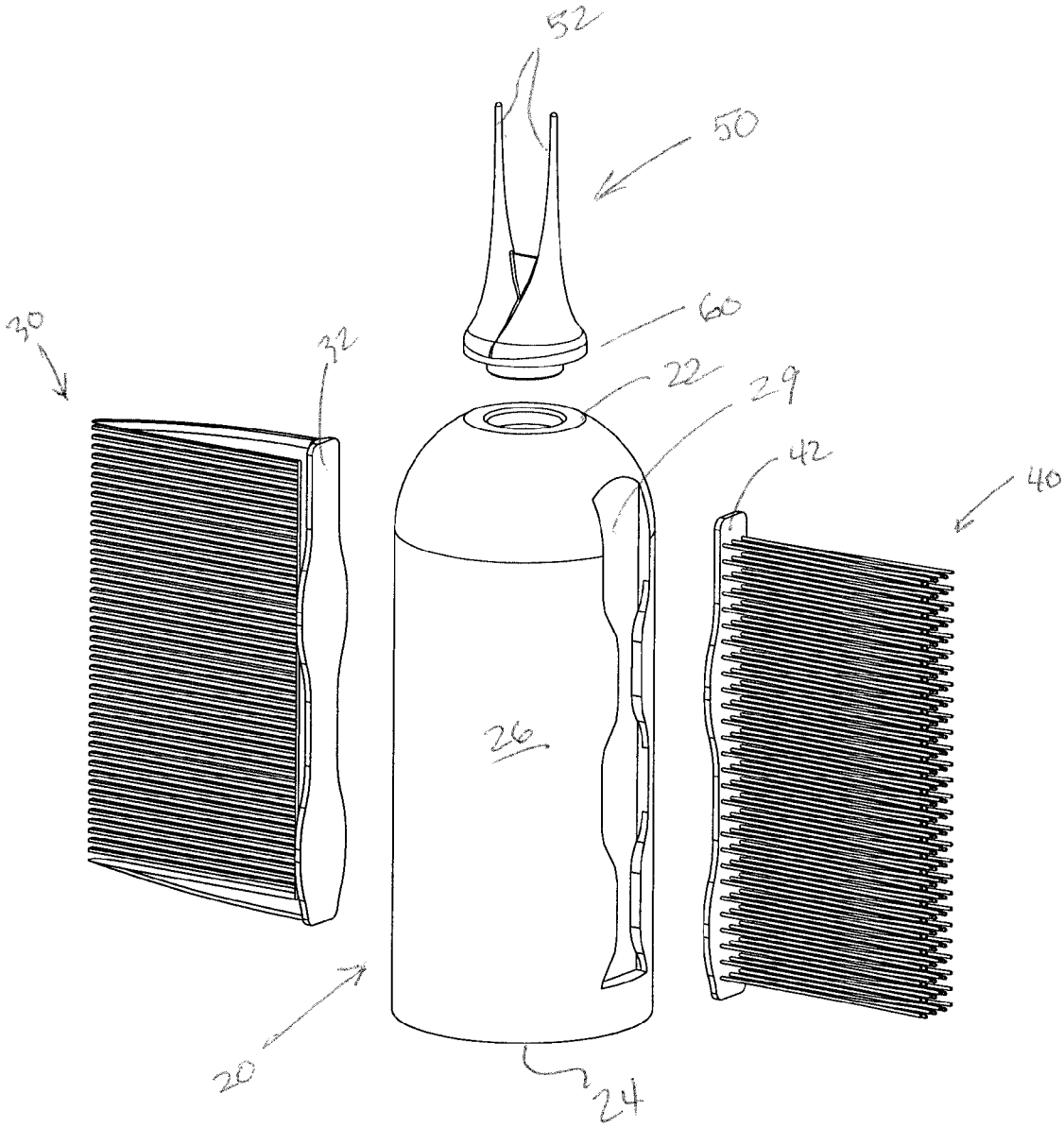
FIG. 2: Deconstructed view of the braid removal tool of FIG. 1

The comb member and brush member may be coupled to an extension device 60 that may then be coupled to the apex 22 of the finger cover 20 (FIG. 2).

The debraiding tool 10 may include a pick member 50 removably coupled to the apex 22 of the finger cover 20. The pick member 50 may include a pair of tines 52 extending away from the apex 22 when coupled thereto. The pick member 50 may attach to the apex 22 with a self-locking mechanism such as a snap, screw, or the like. The pick member 50 itself may be constructed of a hard material from plastic to metal, may be double pronged to facilitate debraiding, and has a sharp point.

Once attached, the unit is placed over a finger and used with the attachments to debraid hair.

The invention claimed is:

1. A braid removal tool for use on a finger of a user, comprising:

a finger cover having an apex and defining an open bottom, said finger cover including a plurality of side walls extending between said apex and said bottom so as to selectively receive the user's finger through said bottom;

wherein:

said finger cover defines an interior area;

a first respective side wall includes a first tongue and groove structure;

a second respective side wall includes a second tongue and groove structure;

a comb member having a comb member connector slidably coupled to said first tongue and groove structure, said comb member having a plurality of bristles extending outwardly from said comb member connector;

a brush member having a brush member connector slidably coupled to said second tongue and groove structure, said brush member having a plurality of bristles extending outwardly from said brush member connector; and a pick member removably coupled to said apex of said finger cover, said pick member having a pair of tines extending away from said apex.

2. The braid removal tool as in claim 1, wherein:

said pick member includes a mounting flange;

said apex includes a mounting opening configured to selectively receive said mounting flange, whereby said pick member is selectively mounted to said apex of said finger cover.

3. The braid removal tool as in claim 1, wherein said finger cover has a thimble shaped configuration.

4. The braid removal tool as in claim 1, wherein said first tongue and groove structure is positioned about 180 degrees from said second tongue and groove structure.

5. The braid removal tool as in claim 2, wherein said pair of tines includes a sharp point.

6. The braid removal tool as in claim 1, wherein said finger cover is constructed of an expandable material.

* * * * *

UNITED STATES PATENT AND TRADEMARK OFFICE

CERTIFICATE OF CORRECTION

PATENT NO. : 8,479,749 B2
APPLICATION NO. : 12/924499
DATED : July 9, 2013
INVENTOR(S) : Andrea Randolph It is certified that error appears in the above-identified patent and that said Letters Patent is hereby corrected as shown below:

Delete title page and substitute the attached title page therefor.

In the Drawings

Delete drawing sheet 1 of 5 and replace the informal drawing of Fig. 1 with the formal drawing of Fig. 1.

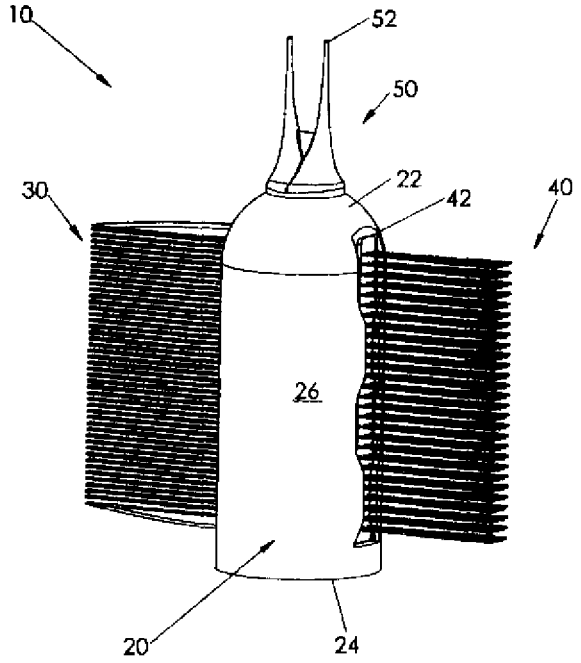

Fig. 1

Signed and Sealed this
Twenty-seventh Day of August, 2013

Teresa Stanek Rea
*Acting Director of the United States Patent and Trademark Office*

Delete drawing sheet 2 of 5 and replace the informal drawing of Fig. 2 with the formal drawing of Fig. 2.

Figure 3:
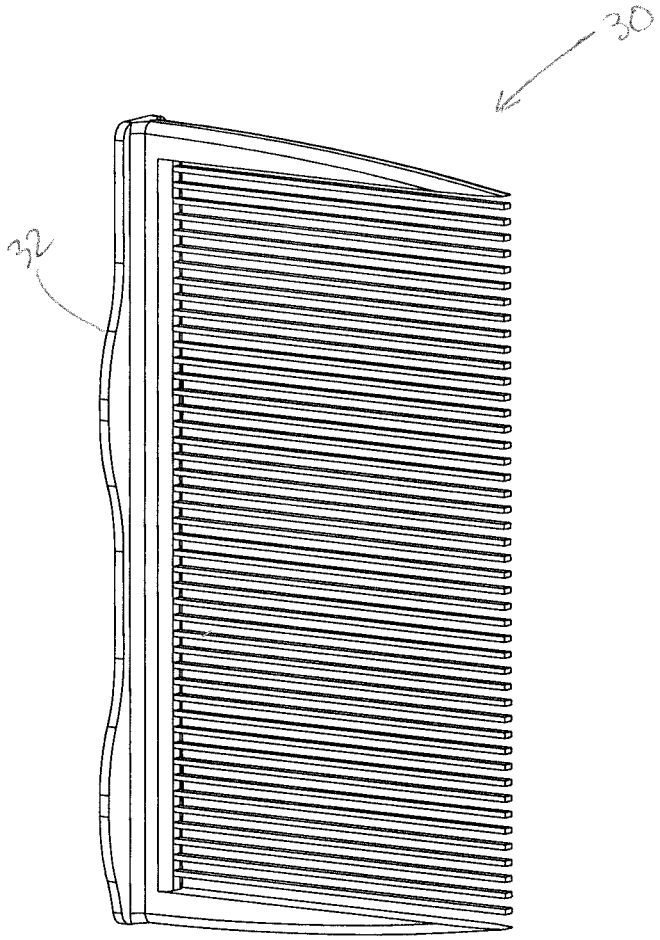
FIG. 3: Comb member

Delete drawing sheet 3 of 5 and replace the informal drawing of Fig. 3 with the formal drawing of Fig. 3.

Figure 4:
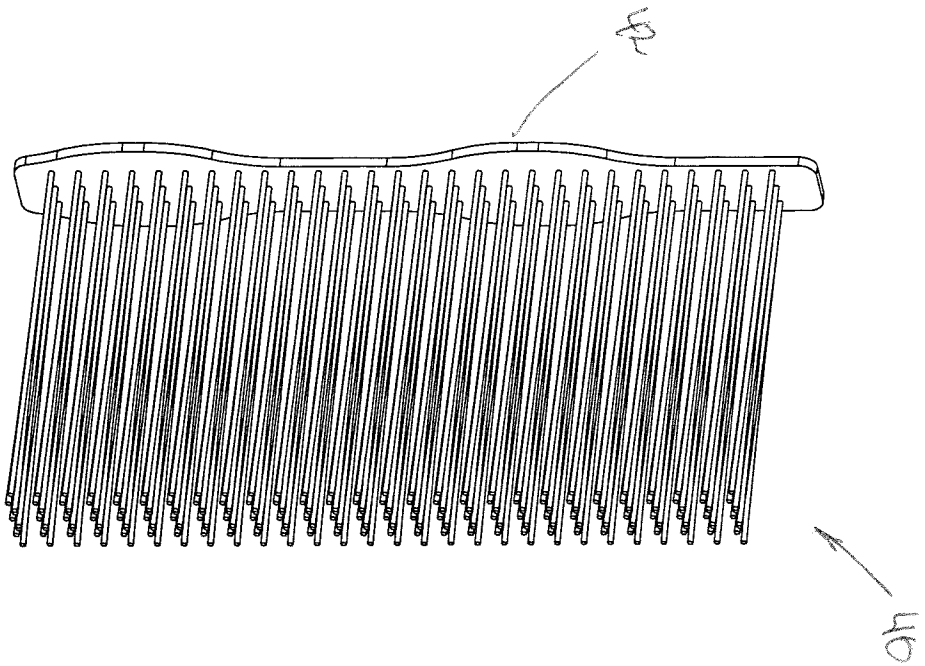
FIG. 4: Brush member

Delete drawing sheet 4 of 5 and replace the informal drawing of Fig. 3 with the formal drawing of Fig. 4.

Figure 5:
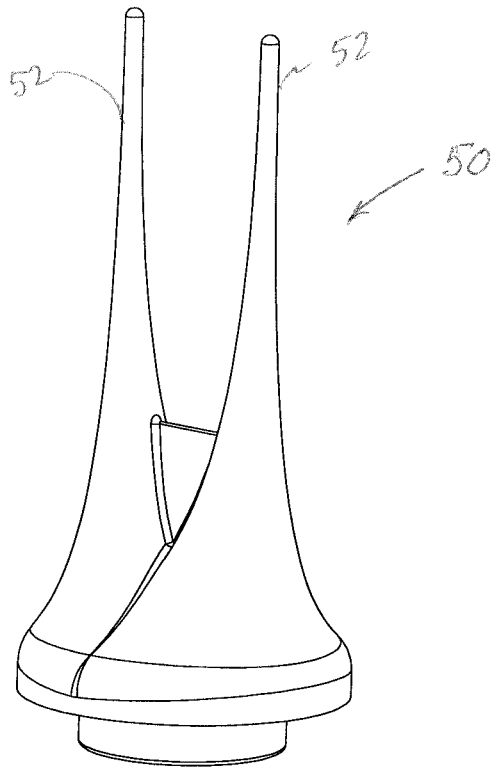
FIG. 5: Pick member
Figure 2:
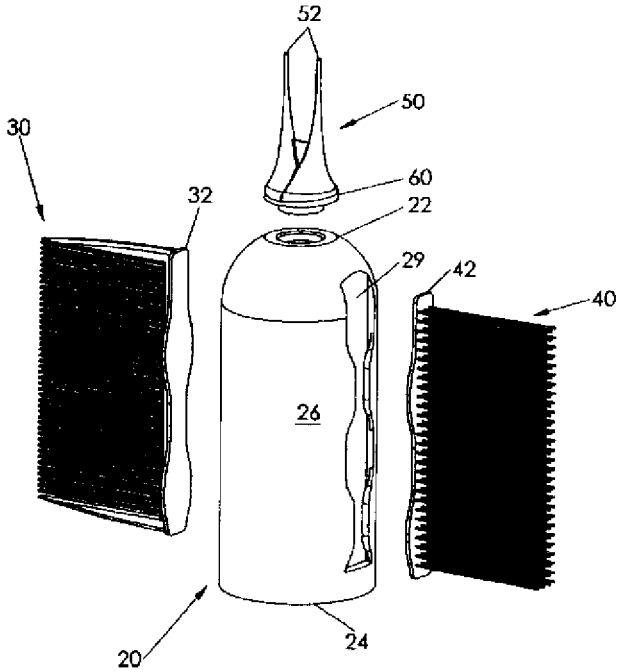
Figure 3:
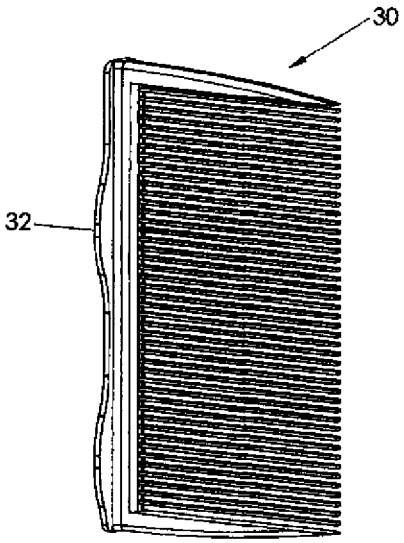
Figure 4:
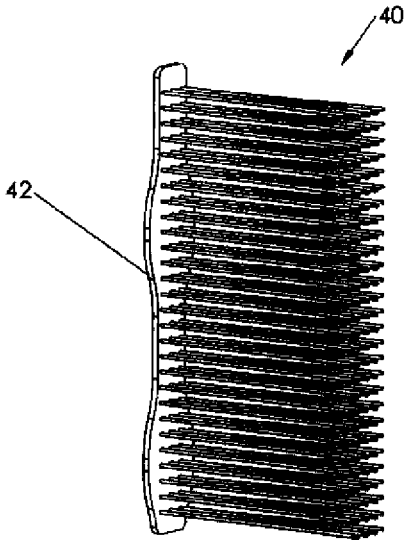
Figure 5:
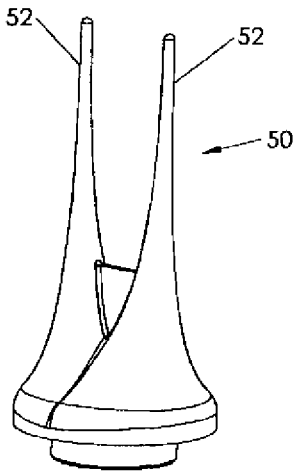

Delete drawing sheet 5 of 5 and replace the informal drawing of Fig. 3 with the formal drawing of Fig. 5.

(12) United States Patent
Randolph

(10) Patent No.: US 8,479,749 B2
(45) Date of Patent: Jul. 9, 2013

(54) HAIR DEBRAIDER

(76) Inventor: Andrea Randolph, Croydon, PA (US)

( * ) Notice: Subject to any disclaimer, the term of this patent is extended or adjusted under 35 U.S.C. 154(b) by 0 days.

(21) Appl. No.: 12/924,499

(22) Filed: Sep. 29, 2010

(65) Prior Publication Data

US 2012/0073593 A1 Mar. 29, 2012

(51) Int. Cl.
*A45D 24/16* (2006.01)

(52) U.S. Cl.
USPC ..... 132/120; 132/149; 2/21

(58) Field of Classification Search
USPC ..... 132/120, 149, 108, 212, 219, 218, 132/270, 273, 317, 320, 321, 329, 126, 124, 132/139, 141, 142, 144; 2/21, 159; 15/105, 15/159.1, 188, 227, 160, 167.1; 119/600, 119/601, 611–617; D28/10; D4/103
See application file for complete search history.

(56) References Cited

U.S. PATENT DOCUMENTS

| | | | | | |
|---|---|---|---|---|---|
| 1,795,500 | A | * | 3/1931 | Omundson | 132/149 |
| 2,154,336 | A | * | 4/1939 | King | 132/139 |
| 2,154,337 | A | * | 4/1939 | King | 132/212 |
| 2,272,151 | A | * | 2/1942 | Hertzberg | 132/120 |
| 2,297,714 | A | * | 10/1942 | Nesbitt | 132/149 |
| D137,637 | S | * | 4/1944 | Nelson et al. | D4/117 |
| 2,467,975 | A | * | 4/1949 | Hollen | 132/149 |
| 2,526,128 | A | * | 10/1950 | Grant | 132/149 |
| 2,568,898 | A | * | 9/1951 | Phillips et al. | 132/150 |
| 2,608,975 | A | * | 9/1952 | Shannon | 132/149 |
| 2,686,325 | A | * | 8/1954 | Silver | 15/188 |
| 2,799,283 | A | * | 7/1957 | Kapusnyk | 132/120 |
| 2,821,203 | A | * | 1/1958 | Kesterson et al. | 132/149 |
| 3,928,871 | A | * | 12/1975 | Wall | 2/161.8 |
| 3,960,155 | A | * | 6/1976 | Wall | 132/212 |
| 4,292,705 | A | * | 10/1981 | Stouffer | 15/110 |
| 4,766,914 | A | * | 8/1988 | Briggs | 132/212 |
| 5,803,322 | A | * | 9/1998 | Boone et al. | 223/101 |
| 6,021,783 | A | * | 2/2000 | Phillips | 132/200 |
| 6,095,154 | A | * | 8/2000 | Robinson | 132/219 |
| 6,808,068 | B2 | * | 10/2004 | Abada | 206/362.2 |
| 7,044,138 | B2 | * | 5/2006 | Brown | 132/139 |
| D648,072 | S | * | 11/2011 | Freeman | D28/31 |
| 2003/0203119 | A1 | * | 10/2003 | Witter | 427/429 |
| 2006/0096610 | A1 | * | 5/2006 | Bradford et al. | 132/212 |
| 2007/0226874 | A1 | * | 10/2007 | Cain | 2/159 |
| 2011/0265808 | A1 | * | 11/2011 | Conn | 132/200 |

* cited by examiner

*Primary Examiner* Robyn Doan
*Assistant Examiner* — Tatiana Nobrega
(74) *Attorney, Agent, or Firm* — Dale J. Ream

(57) ABSTRACT

This invention is a cylindrical device placed on your finger or thumb and contains a 3 piece apparatus that can be detached coming out of the cylinder wither vertically at the apex, or on the sides. There is a pick sticking directly upwards from the finger and a mini comb and a brush between 90 to 180 degrees on each end of the pick (alternative manufacturing methods). The pick is pushed into the center of the braid and will break the braid apart. The comb or brush is used to straighten the hair as the pick breaks the braid apart.
The entire process, while usually performed with two hands, can be accomplished with one hand thus making the device easier, less tiring and less expensive than alternative devices currently on the market.

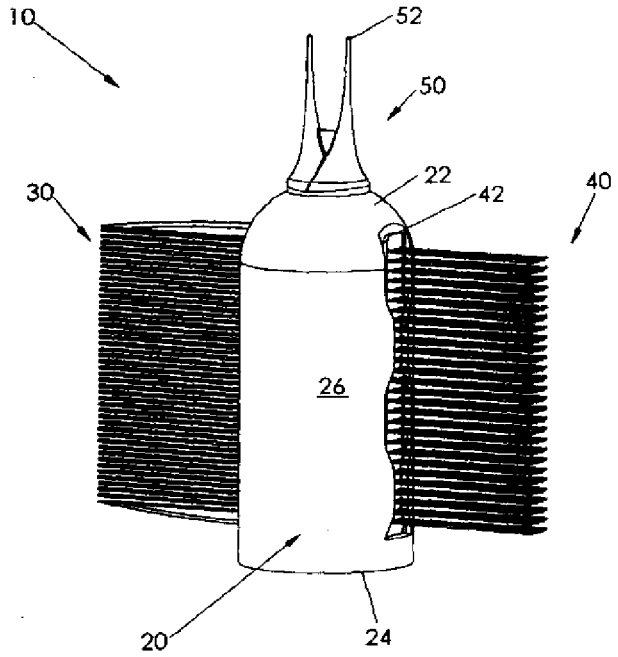

6 Claims, 5 Drawing Sheets